United States Patent [19]

Rellensmann et al.

[11] 4,103,480

[45] Aug. 1, 1978

[54] METHOD FOR PRODUCING TEXTURED FILAMENT YARNS WITH IMPROVED YARN QUALITIES FROM PREORIENTATED POLYAMIDE 6

[75] Inventors: Wolfgang Rellensmann, Dormagen; Michael Bueb, Leverkusen; Lothar Rupprecht, Dormagen; Herbert Schmidt, Dormagen; Wolfram Wagner, Dormagen, all of Germany

[73] Assignee: Bayer Aktiengesellschaft, Leverkusen, Germany

[21] Appl. No.: 776,412

[22] Filed: Mar. 10, 1977

[30] Foreign Application Priority Data

Mar. 12, 1976 [DE] Fed. Rep. of Germany ..... 2610325

[51] Int. Cl.[2] ..... D02G 1/02; D02G 3/04

[52] U.S. Cl. ..... 57/140 R; 57/157 TS

[58] Field of Search ..... 57/140 R, 157 S, 157 TS

[56] References Cited

U.S. PATENT DOCUMENTS

| | | | |
|---|---|---|---|
| 3,858,387 | 1/1975 | Baliga et al. | 57/157 TS X |
| 4,000,605 | 1/1977 | Chimura et al. | 57/157 TS |

*Primary Examiner*—Richard C. Queisser
*Assistant Examiner*—Charles Gorenstein
*Attorney, Agent, or Firm*—Plumley and Tyner

[57] ABSTRACT

The invention is related to a method for producing texturized yarns from polyamide 6 which have small parts of a transitional structure in the α-modification in addition to the predominant α-modification, using a rapidly spun yarn in the α-modification, wherein a yarn with an elongation of 40 to 100% and a density of 1.130 to 1.140 is texturized at texturizing speeds of from 4000 to 1600 m/min at a temperature of from 170° to 220° C while maintaining a constant thread tension ratio of twister outlet to twister inlet of from 1 : 1.0 to 1 : 1.5 by means of a frictional twister while simultaneously stretching in a ratio of from 1 : 1.05 to 1 : 1.5.

4 Claims, 1 Drawing Figure

Figure 1:
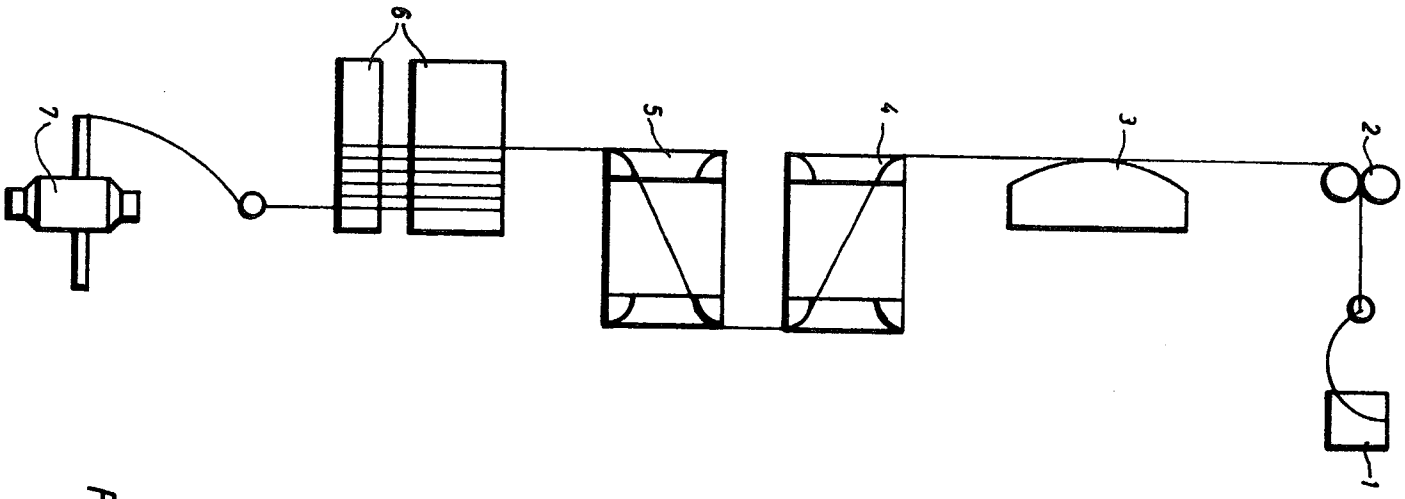

METHOD FOR PRODUCING TEXTURED FILAMENT YARNS WITH IMPROVED YARN QUALITIES FROM PREORIENTATED POLYAMIDE 6

The present invention relates to a method for producing stretch-textured textile filament yarns from polyamide 6 and to a texturised polyamide 6 yarn.

During the production of elastic, textile surface-formations for stockings or ladies' tights, for example, crimped, textile yarns are required. Such yarns keep their specific qualities by being subjected to a texturising method during production.

With the method of the so-called torsional texturising of yarns comprising at least partly thermoplastic, synthetic material these yarns must pass through a heating and a cooling zone one after the other in a twisted condition. The twisting is normally produced by means of a false twisting device with which a torque is transferred to the threads.

The various conventional texturising methods may be distinguished from each other by the stretching of the yarn taking place before or during the texturising process for example. With the method of the so-called simultaneous stretch texturising the yarn is continuously stretched and texturised in one operating stage. The unstretched or partly stretched yarn is thus supplied via a delivery device and normally passes a heating rod. After the heating rod it runs through a cooling zone and subsequently a twister. In the modern methods frictional twisters are usually installed as twisters because, as compared with the classical false twist spindle, they have the advantage of making higher texturising speeds possible.

After leaving the twister the yarn is fed via a stretching godet and reaches the further operational stages which for example can consist of a device for a second heat treatment, a device for a subsequent oiling and a winding device.

The properties of the texturised yarn are essentially determined by the base material, thus in the case of synthetic yarns by the type of polymerisate. Indeed, they are also additionally determined by the type and quality of the spinning method, by the technical execution of the texturising method and by the regulation of the operational parameters for texturising.

The production of yarns with determined properties, such as a good tensile strength, a good crimping geometry, good crimping parameters with regard to crimp, permanence of crimp etc., and low boiling shrinkage is desired. In addition a good uniformity from yarn to yarn is required in order to maintain a uniform knit.

Some very specific requirements for the yarn arise from further processing criteria (knitting, sewing, dyeing, shaping of tights etc.). Thus the yarn should be incorporate into knitting machines too narrowly and a small raw stocking length should be produced. The "contraction" of the stocking, ie. the difference in length between the raw and the dyed stocking supplied should be as small as possible i.e. below 5%.

To increase the certainty of knitting, i.e. to avoid knitting errors, the yarn must as far as possible have no loops in the form of projecting, badly texturised individual filaments.

The above demands generally hold for yarns from polyamide 6 as well as for yarns from polyamide 6,6. Indeed, it is known that chemical-physical difference exist between these two types of polyamide, which perceptibly influence the yarn qualities. Thus it is particularly difficult to produce a texturised yarn from polyamide 6 for example which has the above-mentioned desirable properties. Hitherto this was only achieved essentially by a production process, in which the conventionally spun yarn was firstly stretched flat on a stretching machine and then in a second stage texturised on a false twist spindle machine. On account of the poor economy of such a production process it is certainly desirable to texturise yarn from polyamide 6 by avoiding the stage of the method involving separate smooth stretching, and indeed at the highest possible texturising speed with a frictional twister.

It is known that texturised yarns can be produced in various ways. These production processes are essentially as follows:

(a) Spinning of the yarns at normal doffing speeds between 700 m/min and 1200 m/min, stretching the raw yarns on a stretching machine, and texturising the smoothly stretched yarns on a spindle-texturising machine.

(b) Spinning the yarns at normal doffing speeds between 700 m/min and 1200 m/min, consecutive stretching and texturising of the yarns on a texturising machine with frictional twister and the method of consecutive texturising.

(c) Spinning the yarns at normal doffing speeds between 700 m/min and 1200 m/min, simultaneous stretching and texturising of the yarns on a texturising machine with frictional twister according to the method of the simultaneous stretch texturising.

(d) Spinning the yarns at increased doffing speeds between 2000 m/min and 4000 m/min, simultaneous stretching and texturising of the preorientated yarns on a texturising machine with false twisters according to the method of simultaneous stretch texturising.

There are numerous patents and published specifications, which refer to these methods or to details of these methods, for example to the twister.

In German published specification No. 2,313,723 for example, an internal frictional twister is described.

In German published specification No. 2,422,690 a method for the simultaneous stretch texturising is described which is characterised by specific operational parameters, for example by a low ratio $S_2/S_1$ of the thread drawing powers $S_1$ before the false twister and $S_2$ after the false twister. In this way a yarn with improved yarn qualities can be maintained.

Unfortunately the methods mentioned under (b) and (c), despite the details for improvements suggested in the patent documents, have the disadvantage that the texturised yarns do not have the same good quality formation as in method (a).

Thus for example, the loops which occur especially at coarser titres (higher 20 dtex) are typical for the texturised yarns produced by method (c).

Such loops can be avoided by pre-stretching the yarns as carried out in methods (b) and (d) for example. On the other hand the method (b) has the disadvantage that the uniformity of the texturised yarns from machine point to machine point is generally worse than in method (c).

In recent patent documents the method (d) is also suggested. Thus a method is described in German published patent specification No. 2,207,849 for example, in which the yarn is drawn off in the spinning mill at a speed of at least 2500 m/min "avoiding deformations".

The pre-stretched yarns are texturised on a "false twist machine", on which, "the thread" runs "via the inlet roller device and a heating channel to the false twist spindle, then further to the first doffing device and upon production of so-called set-yarns through a further heating channel to the second doffing device and is finally wound on".

In German published patent specification No. 2,211,843 a method is described in which pre-orientated polyethylene terephthalate or copolyester are provided as raw yarn for the texturising machine. The stretching on the texturising machine takes place consecutively or simultaneously.

In German published patent specification Nos. 2,241,718 and 2,341,748 methods for producing texturised yarns are also described, in which pre-orientated polyester yarns are used as operative yarn before the texturising.

It follows from these publications, that the production of rapid spun, pre-orientated yarns and the subsequent texturising is normally carried out with polyester and can be carried out relatively easily with a spindle on conventional false twist texturising machines. No detailed operational features or embodiments are given for polyamide. This is because a similar operating procedure during the production of polyamide 6 stocking yarns runs up against severe difficulties. These are partly based on the fact that the fine titres of 22 to 55 dtex which are normal for the production of stockings are particularly difficult to spin and to texturise.

The object of the invention is to texturise rapidly spun, pre-orientated polyamide 6 yarns according to the method of simultaneous-stretch texturising with frictional twister, these yarns having improved physical and textile qualities with regard to their processing into stockings or tights.

According to the invention, there is provided a method for producing texturised yarns from polyamide 6 which have small parts of a transitional structure in the $\alpha$-modification in addition to the predominant $\gamma$-modification, using a rapidly spun yarn in the $\gamma$-modification, wherein a yarn with an elongation of 40 to 100% and a density of 1.130 to 1.140 is texturised at texturising speeds of from 400 to 1600 m/min at a temperature of from 170° to 220° C while maintaining a constant thread tension ratio of twister outlet to twister inlet of from 1 : 1.0 to 1 : 1.5 by means of a frictional twister while simultaneously stretching in a ratio of from 1 : 1.05 to 1 : 1.5.

The single FIGURE shows schematically, the process of the present invention.

The thread tension ratio of twister inlet to twister outlet is preferably regulated to the values 1.1 to 1.3. Surprisingly the twister systems which are described in German Offenlegungsschrift No. 2,313,723 are shown to be particularly suitable for regulating these values for polyamide 6 yarns according to the invention, exclusively occurring in the $\alpha$-modification. In addition to the temperature conditions, the stretching conditions and the regulated texturising speeds, these tension ratios are responsible for seeing that the $\gamma$-modification is only partially converted into the $\alpha$-modification. The extent of the conversion is quantifiably established by the combination of the operational parameters of temperature, texturising speed, tension ratio and stretching ratio as well as by the yarn used, which, moreover, is the object of British patent application No. 8890-76. Only then, when the texturised yarn has transitional structures to the $\alpha$-modification to the extent specified, can the optimum yarn qualities be established in the yarn itself and in the fine stocking.

The stretch ratio in the texturising zone is preferably from 1:1.19 to 1:1.25. Preferred texturising speeds lie between 600 and 1200 m/min. Thread tension ratios which are preferably in combination with the values for temperature, speed, and stretching ratios, lie between 1.1 and 1.3.

Before the yarn is wound onto a cop or onto a lapping unit, at lapping speeds of 400 to 1600 m/min, preferably 600 to 1200 m/min, it receives a post-preparation by means of known bobbin oils. If necessary, a set-process can also be carried out shortly before winding on by means of a heat treatment. As far as possible one of the cooling zones determined by and adapted to the operational speeds, should be run through between a fixing heating and twister. The surrounding air as well as ducted cooling by means of fins can be used as cooling media. The tension ratio $S_2/S_1$ must preferably be 1:1 or slightly above. It is regulated by altering D/Y (see Example). The ratio number of rotations of twister to yarn doffing speed should lie between 30 to 40 (d/G see Examples). The yarn is twisted inside the texturising zone so strongly that the twisting which is dependent on the titre is 5 to 50% higher than in the hitherto normal false twisting method with the normal twisting with the spindle and which can be calculated with the aid of the known "Heberlein" formula for example.

The thread path is shown in FIG. 1. The thread is drawn off the delivery device 2 from a spinning bobbin 1. The thread is stretched between the delivery device 2 and a doffing device 6. A twisting device 4/5 and a fixing heater 3 are arranged in the stretching section. The thread is cooled by the surrounding air after the doffing device 6 — ducted cooling with air or water may also be used — the thread is, moreover, fed via a post-oiling device (not shown here) and wound onto a cop 7 by means of a ring and traveller. In order to obtain a constant twisting balloon tension the number of rotations of the spindle is regulated according to a specific plan.

A further important factor for optimum yarn qualities in the texturised end product is the selection of a suitable starting material. It is of importance in this connection, not to use any random polyamide 6 yarn for texturising but to insert a yarn from which the desired yarn and characterised further below by its qualities is produced by applying the above-described operational stages which are carefully determined one after another.

The starting yarn, which is not the object of the present invention, is described in British patent application No. 8890-76. The yarns are produced by spinning continuous polyamide 6 threads with a relative viscosity of 2.3 to 3.1. The threads are cooled after leaving the spinning nozzle by being blown on with air and are pre-orientated to an elongation at break of 40 to 100%, preferably 50 to 80% by being doffed preferably without godets, at speeds of 3000 to 7000 m/min, preferably <4000 m/min, but particularly 4000 to 5000 m/min and are prepared with a diluted preparational oil dressing before winding on and during doffing, in such a way that they contain less than 3.0% by weight water.

If necessary, the threads which are obtained in this way can be interlaced before being wound on and before texturising.

The starting yarns are distinguished by the fact that they are in the $\gamma$-modification before as well as after stretching at room temperature. In the $CuK_\alpha$-X-ray diagram they do not demonstrate a (020)-reflex either before or after a stretching at room temperature. The intensity ratio of the reflexes (002) and (200) lies above 1.1 and their orientation of the equatorial (200)-reflex, which is defined as the reciprocal value of the half half-width value of the azimuthal intensity distribution of the (200)-reflex, $>0.08$.

The starting yarns thus described are texturised according to the method of the invention. The radiographic structural photographs are particularly characteristic for the threads produced in accordance with the invention, these photographs showing in addition to the major part in the high orientated $\gamma$-modification a small part in transitional structure to the $\alpha$-modification. This new type of structure cannot be clearly described by the intensity ratio of the X-ray reflex I(002)/I(200) as in the case of conventionally produced yarns, since the intensity of the (200)-reflex cannot always be given clearly. In the present case however the intensity of the (002)-reflex can relate to the meridian over the entire surface F under the accurate equator curve, for describing the new type of yarns in accordance with the invention, and thus a standardized size $H_{002} = I(002)_F$ [1/degree] is obtained. For the yarns according to the invention the value for this size lies in the range of $H_{002} = 0.2$ to 0.9, preferably 0.4 to 0.6 [1/degree].

In the case of the pre-orientated base yarn, the size $H_{002}$ lies at a value of 1.1 [1/degree].

Similarly the values for conventional spinning material lie at a value $H_{002} = 0.07$ [1/degree] and after texturising of the conventional spinning material at a value $H_{002} = 0.03$ [1/degree].

The advantages aimed at in the invention consist particularly in the fact that texturised yarns with improved qualities can be produced, having advantages for further processing in the knitting industry and being particulary suitable for the modern, rational method of producing stockings, as for example 8- or 12-system one-piece-technique or 4-system rapid spinning technique in connection with the Takatori-sewing technique, thus a method which is exacting with regard to operational safety and stocking shrinking method.

In the further processing of the yarns produced in accordance with the invention, no disturbance occurs as the result of dropped stitches or of spliced capillary bandages (so-called filamentation) at knitting speeds of 500 trs/min for example on a so-called one-piece-machine when knitting leg parts and in particular lace parts even when using an extremely slack knitting method. The tights supplied have well adjusted shapes and excellent qualities of wear.

The yarn can also be knitted into tights with the desired stretch widths and adjusted shapes without interference at knitting speeds of up to 900 trs/min on the so-called rapid running machines. The individual stockings prepared in this way are particularly distinguished with regard to the upper part by relatively small table masses, this having a particularly good effect during the subsequent rapid stitching technique, for example on Takatori-machines, with regard to a safe stitch guide.

EXAMPLES 1 - 6

Various examples for internal and external friction and for various texturising speeds are given in Table 1. A representative Example 1 is described in detail for this.

A PA 6-filament yarn with a raw titre of dtex 52.0, rapidly spun at 3995 m/min, is provided for a stretch texturising machine shown in FIG. 1. The elongation amounts to 70%.

The delivery of the thread follows at a speed of 413.2 m/min. The doffing speed is 500 m/min and the stretching ratio resulting from these speeds is 1:1.2.

The titre of the ready texturised yarn is dtex 43.7. The temperature of the heating rod for fixing the false twist is 185° C, the number of rotations of the twister 18,000 r.p.m.

The ratio d/G ($d$ = rotation of the internal frictional twister, G = doffing speed m/min) namely 18,000:500 = 36 is calculated from the number of rotations of the false twist device per minute and the doffing speed m/min.

The tension ratio of the thread tension after the twisting device ($S_2$) and the thread tension before the twisting device ($S_1$) $S_2$:$S_1$ is 1.3:1; measured absolutely 13p:10p.

The yarn between the doffing godet 6 and cop 7 is provided with a suitable bobbin oil according to FIG. 1 in order to guarantee good running off qualities of the cop during later processing in the knitting mill. The yarn which is produced in the above-mentioned manner has a boiling shrinkage of 3.6% and a thermal shrinkage of 2.6%. The shrinkage of the stockings prepared from this material amounts to around 3%.

The shrinkage is defined by the length difference in percent of the loaded raw to the loaded finished stocking. A weight of 2 kp is inserted in the stocking length for stressing.

$$\text{Contraction \%} = \frac{\text{Raw stocking length (loaded)} - \text{finished stocking length (loaded)}}{\text{Raw stocking length (loaded)}} \cdot 100$$

TABLE I

| | Set titre dtex | Friction type | Text.-speed m/min | I=d/G A=D/Y | Stretching ratio 1: | Heating rods Temp ° C | $S_2/S_1$ | actual titre dtex | Elongation % | Strength Rkm | Boiling shrinkage % | Thermal shrinkage % at 195° C | Contraction% |
|---|---|---|---|---|---|---|---|---|---|---|---|---|---|
| 1 | 44f10 | I | 500 | 36 | 1.21 | 185 | 1.3 | 43.7 | 34.8 | 40.9 | 3.6 | 2.6 | 3.0 |
| 2 | 44f10 | I | 700 | 33 | 1.25 | 210 | 1.2 | 43.4 | 32.7 | 45.2 | 4.7 | 3.5 | 4.1 |
| 3 | 55f12 | I | 500 | 36 | 1.21 | 195 | 1.3 | 53.6 | 34.2 | 41.1 | 5.0 | 3.6 | 4.7 |
| 4 | 22f5 | A | 800 | 1.4 | 1.2 | 185 | 1.07 | 20.9 | 32.3 | 45.5 | 4.8 | 2.8 | 5.0 |
| 5 | 22f5 | A | 1000 | 1.4 | 1.2 | 202 | 1.08 | 20.9 | 30.4 | 42.4 | 4.5 | 3.2 | 4.8 |
| 6 | 44f10 | A | 800 | 1.4 | 1.2 | 195 | 1.1 | 42.2 | 31.2 | 42.4 | 5.0 | 3.4 | 4.5 |

I = Internal friction.
A = External friction.
D/Y = Twister speed m/min/Doffing speed m/min at A
d/G = Twister speed rpm/Doffing speed m/min at I

What is claimed is:

1. A method for producing texturised yarns from polyamide 6 which have small parts of a transitional structure in the $\alpha$-modification in addition to the predominant $\gamma$-modification, using a rapidly spun yarn in the $\gamma$-modification, wherein a yarn with an elongation of 40 to 100% and a density of 1.130 to 1.140 is texturised at texturising speeds of from 400 to 1600 m/min at a temperature of from 170° to 220° C while maintaining a constant thread tension ratio of twister outlet to twister inlet of from 1:1.0 to 1:1.5 by means of a frictional twister while simultaneously stretching in a ratio of from 1:1.05 to 1:1.5.

2. A method as claimed in claim 1, wherein the temperature in the stretch texturising zone is from 180° to 200° C, the thread tension ratio of twister outlet to twister inlet is from 1:1.1 to 1:1.3, the texturising speed is from 600 to 1200 m/min, and the yarn density is from 1.132 to 1.137.

3. A method as claimed in claim 1, wherein the stretching ratio is from 1:1.19 to 1:1.25.

4. A false twist, texturised polyamide 6 yarn, of which the intensity of the standardized meridian reflex (002), determined by measuring the $CuK_\alpha$-X-ray diagram has a value of $H_{002}$ of from 0.2 to 0.9 [1/degree], wherein $H_{002}$ is defined as the intensity of the (002)-reflex in relation to the total surface under the equatorial deviation ($H_{002} = I(002)/_F$).

* * * * *